US005540385A

United States Patent [19]

Garlick

[11] Patent Number: 5,540,385

[45] Date of Patent: Jul. 30, 1996

[54] SPRAY NOZZLE FOR HIGH VOLUME LOW PRESSURE AIR

[75] Inventor: Paul L. Garlick, Poole, United Kingdom

[73] Assignee: ITW Limited, United Kingdom

[21] Appl. No.: 332,954

[22] Filed: Nov. 1, 1994

[30] Foreign Application Priority Data

Nov. 22, 1993 [GB] United Kingdom ..... 9324006

[51] Int. Cl.[6] ..... B05B 1/02; B05B 7/08

[52] U.S. Cl. ..... 239/290; 239/417.3; 239/424; 239/296

[58] Field of Search ..... 239/290, 296, 239/417.3, 424

[56] References Cited

U.S. PATENT DOCUMENTS

| | | | |
|---|---|---|---|
| 4,844,347 | 7/1989 | Konhäuser et al. | 239/296 |
| 4,917,300 | 4/1990 | Gloviak et al. | 239/296 X |
| 5,088,648 | 2/1992 | Schmon | 239/296 |
| 5,209,405 | 5/1993 | Robinson et al. | 239/296 |
| 5,456,414 | 10/1995 | Burns et al. | 239/296 |

FOREIGN PATENT DOCUMENTS

| | | | |
|---|---|---|---|
| 408786 | 1/1991 | European Pat. Off. | 239/296 |
| 2698291 | 5/1994 | France | 239/296 |
| 288469 | 4/1928 | United Kingdom . | |
| 459776 | 1/1937 | United Kingdom . | |
| 563174 | 8/1944 | United Kingdom . | |
| 1163033 | 9/1966 | United Kingdom . | |
| WO92/17279 | 10/1992 | WIPO . | |

*Primary Examiner*—Andres Kashnikow
*Assistant Examiner*—Lesley D. Morris
*Attorney, Agent, or Firm*—MacMillan, Sobanski & Todd

[57] ABSTRACT

A spray nozzle operating on low air pressure is described comprising a nozzle to which a fluid to be sprayed is fed as indicated by the arrows and the flow of fluid is metered by a needle valve. Encircling the nozzle is an air cap along which air is fed, as indicated by the arrow to atomize the fluid and transfer it onto the workpiece to be sprayed. The outward shape of the nozzle is configured with a taper from the large outer diameter of the nozzle at a steep angle and by a further taper at a shallow angle to a small cylindrical tip which projects slightly in front of the front face of the air cap. A concave radius is formed between the taper and the end face measuring between 3 mm and 0.5 mm.

6 Claims, 1 Drawing Sheet

SPRAY NOZZLE FOR HIGH VOLUME LOW PRESSURE AIR

This invention relates to an improved spray nozzle more particularly for spraying fluids using high volume low pressure air.

Nozzles designed for co-axial air-blast atomizers using high (>2.1 bar) pressure compressed air are known. The outer surface of these nozzles taper from a large diameter to a small diameter at a steep angle and a shallower one and end in a small parallel section. An air cap fits over the nozzle in such a way that the air jet emitted sets up a region of reduced pressure just in front of the nozzle. In some known designs the region of reduced pressure is sufficient to draw up enough liquid to be atomized without the need for an externally applied pressure feed. With this type of arrangement it is the high energy of the emerging air jet that atomizes the liquid jet to a degree fine enough for high quality spray finishing.

In the development of low pressure spraying equipment where the available energy from the emerging jet is not so high, it has been found that the geometry of the nozzle and air cap has to be improved in order to maintain a similar degree of atomization. A recently developed nozzle has just one taper angle on the nozzle without a parallel section at the end. The cap bore (typically 6.2 mm) is considerably larger than that of the high pressure nozzle (typically 3.1 mm)

The disadvantage of the low pressure nozzle is that instead of producing a region of reduced pressure in front of the nozzle, the emerging jet produces a region of raised pressure. This raised pressure often referred to as "back pressure" causes unwanted side effects that detract from the ease of use and all-purpose suitability of the low pressure nozzle.

An aim of the present invention is to provide an improved spray nozzle operating on low air pressure which overcomes the disadvantages of the prior art constructions.

According to the present invention there is provided a spray nozzle operating on low air pressure comprising a nozzle and an air cap with a central aperture encircling the nozzle, wherein the nozzle tapers from its outside diameter towards an end face perpendicular to the nozzle axis and in which a concave radius between 3 mm and 0.5 mm is formed between the taper and the end face.

The outer diameter of the end face is preferably between 1.0 mm and 3.5 mm.

Conveniently, the included angle of the taper is between 60° and 90°.

In a preferred construction, the nozzle has a needle valve positioned axially of the nozzle to meter a supply of fluid to the nozzle outlet.

An embodiment of the improved spray nozzle will now be described, by way of example only, with reference to the accompanying drawings, in which.

Figure 1:
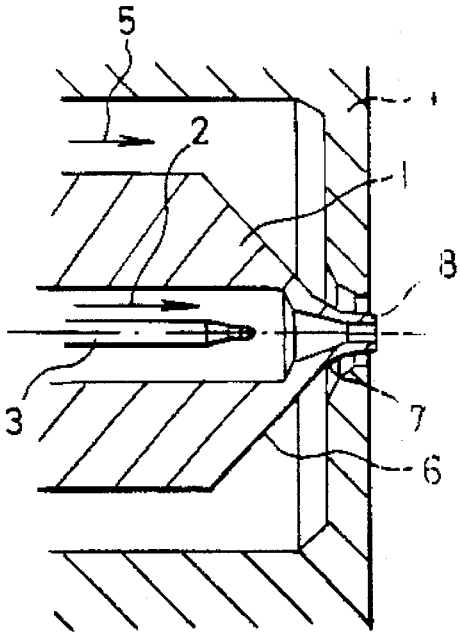
FIG. 1 is a fragmentary axial cross-section of a first prior art spray nozzle.

The prior art construction shown in FIG. 1 comprises a high pressure nozzle 1 to which the fluid to be sprayed is fed as indicated by the arrows 2 and the flow of fluid is metered by a needle valve 3. Encircling the nozzle 1 is an air cap 4 along which air is fed, as indicated by the arrow 5, to atomize the fluid and transfer it onto the workpiece to be sprayed.

The outward shape of the nozzle is configured with a taper 6 from the large outer diameter of the nozzle 1 at a steep angle and by a further taper 7 at a shallow angle to a small cylindrical tip 8 which projects slightly in front of the front face of the air cap 4.

The air cap is positioned relative to the nozzle tip so that the air jet emitted from the spray nozzle sets up a region of reduced pressure just in front of the nozzle. In some nozzles of this construction this region of reduced pressure is sufficient to draw up enough liquid to be atomized without the need for an externally applied pressure feed.

Figure 2:
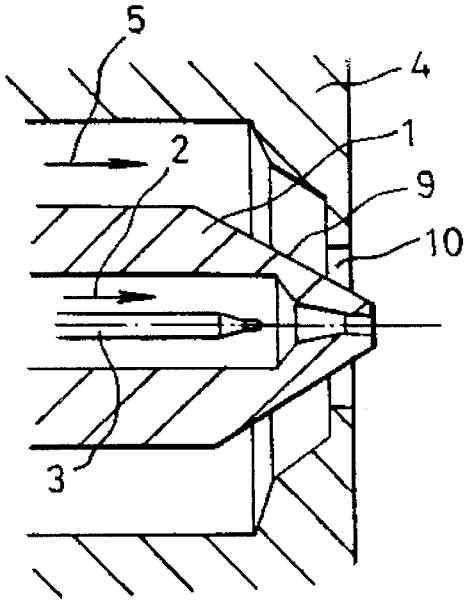
FIG. 2 is a fragmentary axial section of a second prior art spray nozzle.

In the second prior art construction shown in FIG. 2, this comprises a low pressure spray nozzle having a nozzle 1 to which fluid to be sprayed is fed in the direction of the arrow 2 and the flow of fluid is metered by a needle 3. Encircling the nozzle 1 is an air cap 4 along which air is fed in the direction of the arrow 5.

The outward shape of the nozzle 1 is shaped with a tapered angle 9 of the nozzle 1 directly from the outside diameter of the nozzle to its tip. The aperture 10 in the air-cap through which the nozzle tip projects is considerably larger than the aperture of the FIG. 1 construction.

The principal advantage of the low pressure nozzle is that the low energy spray plume does not disperse the atomized particles into the atmosphere to the same extent as the plumes created by the high pressure design of FIG. 1. Consequently the flow pressure nozzle is more efficient in transferring the fluid being sprayed from its reservoir onto the workpiece. This is referred to as an improvement in the "transfer efficiency".

The main disadvantage of the low pressure spray nozzle shown in FIG. 2, is that instead of producing a region of reduced pressure in front of the nozzle, the emerging jet produces a region of raised pressure. This raised pressure subsequently referred to as "back pressure" causes unwanted side effects examples of which are as follows:

(1) In setting up a pressure fed liquid flow for a spray gun using a conventional method of jetting fluid into a container with the air supply turned off, allowance must be made for the effect of the back pressure when the air supply is turned on. This means that accurate flow compensation for back pressure can be time consuming.

ii) When turning from fan spray to round spray it is sometimes the case that the atomizing air pressure increases, this in turn raises the back pressure and reduces the fluid flow in the pressure fed system. In an extreme case the flow can be cut off altogether and air fed back into the reservoir.

(iii) This type of low pressure construction is not suitable for spray guns without needle valves, for example some automatic electrostatic guns, as the back pressure on the liquid is not released until the air supply is turned off. This means that, without a needle valve, the spray gun is unable to prevent a small quantity of liquid from being ejected from the nozzle when the air supply is turned off the back pressure is removed and the pressure in the fluid hose returns to atmosphere. The large un-atomized drops of fluid, e.g. paint, produced would spoil the finish of the workpiece being sprayed.

The improved spray nozzle construction enables the benefits of low pressure spraying technology to be realized without the associated problems caused by back pressure.

Figure 3:
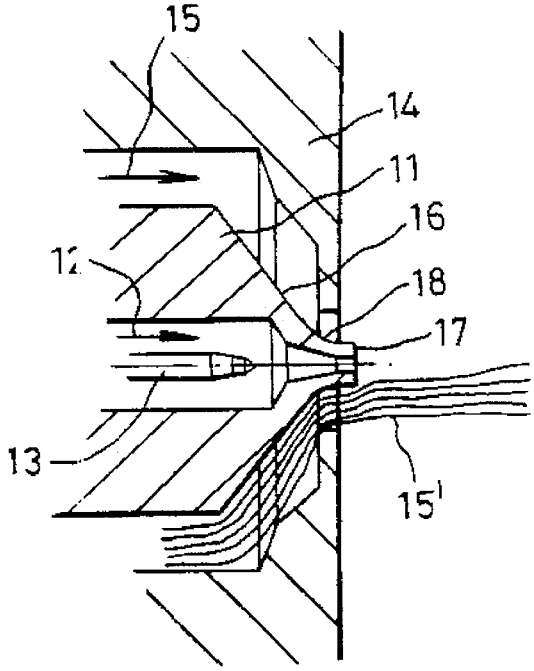
FIG. 3 is a fragmentary axial cross-section of the improved spray nozzle, according to the invention.
Figure 4:
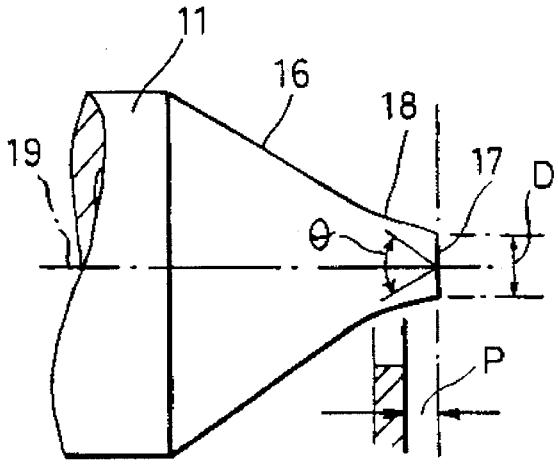
FIG. 4 is an enlarged diagrammatic view of the spray nozzle shown in FIG. 3.

The improved spray nozzle of the present invention is shown in FIGS. 3 and 4 and comprises a nozzle 11 to which-a fluid is fed in the direction of the arrow 12, the flow of fluid being metered by a needle valve 13. Encircling the nozzle 11 is an air cap 14 along which low pressure air (<0.7 bar) is fed in the direction of the arrow 15. The outward shape of the nozzle 11 tapers at 16 from its outside diameter to the end face 17 with a small concave radius 18 between the taper 16 and end face 17.

As shown in more detail in FIG. 4, the small radius 18 blends into the taper 16 at its starting point and ends at the point where its tangent becomes parallel with the nozzle axis 19. The radius has the effect of deflecting the inside part of the annular air jet by an amount sufficient to prevent the formation of a stagnation point just in front of the nozzle 11 (see the streamlines 15' shown in FIG. 3). Thus the pressure of the air jet is free to equalize with the atmospheric pressure and the fluid jet is not subjected to any back pressure.

It is conventional practice to grind sharp corners to remove burrs or other sharp edges when finishing component parts, however it is important that the radius 18 forms a sharp corner with the end face 17 of the nozzle.

A typical value for the radius 18 is 1.4 mm. If the radius is too small say less than 0.5 mm, the back pressure effect will return and when the radius is too large, say greater than 3 mm, the quality of atomization is reduced. The included cone angle θ may vary between 60° and 90°, the end face outer diameter D can vary between 1.0 mm and 3.5 mm, and the protrusion P can vary between zero and 2.5 mm.

I claim:

1. A spray nozzle operating on a low air pressure comprising a nozzle having a longitudinal axis and an end face with an outlet, an air cap, said air cap defining a central aperture encircling said nozzle, wherein said nozzle tapers from an outside diameter towards said end face perpendicular to said nozzle longitudinal axis, and in which a concave radius is formed between said taper and said end face measuring between 3 mm and 0.5 mm.

2. A spray nozzle as claimed in claim 1, wherein an included angle of said taper is between 60° and 90°.

3. A spray nozzle as claimed in claim 2, wherein an outer diameter of said end face measures between 1.0 mm and 3.5 mm.

4. A spray nozzle as claimed in claim 3, wherein the distance said nozzle protrudes from said front face of said air cap is between zero and 2.5 mm.

5. A spray nozzle as claimed in claim 4, wherein the air pressure exiting from said nozzle outlet is less than 0.7 bar.

6. A spray nozzle as claimed in claim 5, wherein a needle valve is positioned axially of said nozzle to meter a supply of fluid to said nozzle outlet.

* * * * *